US011617932B2

(12) United States Patent
Chen

(10) Patent No.: US 11,617,932 B2
(45) Date of Patent: Apr. 4, 2023

(54) RACKET SHOCK-ABSORBING DEVICE

(71) Applicant: Wei-Jung Chen, Taipei (TW)

(72) Inventor: Wei-Jung Chen, Taipei (TW)

( * ) Notice: Subject to any disclaimer, the term of this patent is extended or adjusted under 35 U.S.C. 154(b) by 162 days.

(21) Appl. No.: 17/243,240

(22) Filed: Apr. 28, 2021

(65) Prior Publication Data

US 2022/0347535 A1 Nov. 3, 2022

(51) Int. Cl.
*A63B 60/54* (2015.01)
*A63B 49/022* (2015.01)

(52) U.S. Cl.
CPC ..... *A63B 60/54* (2015.10); *A63B 49/022* (2015.10)

(58) Field of Classification Search
CPC ..... A63B 60/54; A63B 49/022
See application file for complete search history.

(56) References Cited

U.S. PATENT DOCUMENTS 4,927,143 A * 5/1990 Hillock ..... A63B 60/54 473/522
5,776,020 A * 7/1998 Barone ..... A63B 60/54 473/522
5,871,409 A * 2/1999 Kimoto ..... A63B 60/54 473/522
7,335,118 B1 * 2/2008 Sung ..... A63B 69/38 473/553
2004/0023738 A1 * 2/2004 Sung ..... A63B 51/10 473/522
2006/0079352 A1 * 4/2006 Sung ..... A63B 60/54 473/520
2006/0172827 A1 * 8/2006 Soekahar ..... A63B 60/54 473/520
2007/0265120 A1 * 11/2007 Hickey ..... A63B 60/54 377/5
2017/0182390 A1 * 6/2017 Sung ..... A63B 60/54

* cited by examiner

*Primary Examiner* — Jeffrey S Vanderveen
(74) *Attorney, Agent, or Firm* — Guice Patents PLLC

(57) ABSTRACT

A racket shock-absorbing device comprises: a lower hard seat member, disposed at a periphery of a racket frame of a racket and arranged between two single grommets respectively formed with a string hole allowing a string to be disposed, and a top end thereof is disposed with one or more than two protrusions, and the lower hard seat member is formed with a recess; at least one upper soft pad member, disposed on a top end of the lower hard seat member, wherein one or more than two buckle slots is disposed inside the upper soft pad member and arranged correspondingly to the one or more than two protrusions of the lower hard seat member, the string is crossly disposed and downwardly pressed at a top end defined at a center of the upper soft pad member and arranged correspondingly to the recess of the lower hard seat member.

10 Claims, 8 Drawing Sheets

RACKET SHOCK-ABSORBING DEVICE

BACKGROUND OF THE INVENTION

1. Field of the Invention

The present invention relates to a shock-absorbing device, especially to a racket shock-absorbing device capable of interfering and bearing and damping shock waves of a counter shock force generated when a string of a racket face and a racket is struck so as to reduce the shock wave being transferred to a wrist or an arm of a user.

2. Description of Related Art

A conventional racket is provided with longitudinal and transversal (defined as a Y-axis and an X-axis) strings on a racket frame of the racket, the racket frame is provided with longitudinal and transversal string holes which are symmetrically arranged on a periphery thereof, a single grommet is disposed inside the string hole, the string is disposed inside the single grommet so as to be woven for forming a racket surface having a certain tension (as known as pounds), the racket frame having the strings is formed as a racket which is used in various exciting ball games, for example tennis, badminton or squash; for allowing a ball to be received in a sweet spot of the racket surface, the sportsman holding the racket has to rapidly response and move and has a continuous focus, it is more important that shock waves of a counter shock force generated in an instant striking moment of the string of the racket frame being in contact with the ball may let the wrist or the arm of the sportsman feel numb, and the counter shock force and the tension (tightness) of the string is in a direct ratio, in other words the higher the tension, the greater the counter shock force, the counter shock force would be transferred to the wrist or the arm through the racket, so that sport damages, for example tennis elbow due to backhand striking or golf elbow due to positive striking, may happen because there is no shock-absorbing device provided between the strings woven on the racket frame of the conventional racket, the shock waves of the counter shock force generated in the instant striking moment of the racket frame composed of the strings being in contact with the ball could not be absorbed and damped thereby being fully transferred to the wrist and the arm, and the racket is unable to be stably held by the sportsman, moreover, the weight of the periphery of the conventional racket frame cannot be adjusted with respect to requirements of the user; accordingly, the practicability is very much limited; as such, the above-mentioned shortages shall be improved by the skilled people in the art.

SUMMARY OF THE INVENTION

For solving the shortages existed in the prior art, one primary objective of the present invention is to provide a racket shock-absorbing device, in which the shock-absorbing device comprises a lower hard seat member and an upper soft pad member, the lower hard seat member is provided with a protrusion and a recess, the upper soft pad member is disposed on a top end of the lower hard seat member or on a top end of another upper soft pad member having other units, and the upper soft pad member is provided with a buckle slot arranged correspondingly to the protrusion of the lower hard seat member, thereby solving the shortages existed in the prior art.

Another primary objective of the present invention is to provide a racket shock-absorbing device, in which the shock-absorbing device comprises a lower hard seat member and an upper soft pad member disposed between two single grommets of a racket frame, advantages of providing interferences at different timings and capable of bearing shock waves of a counter shock force generated while a string being used for striking a ball for achieving a shock-absorbing and damping effect can be provided.

One another primary objective of the present invention is to provide a racket shock-absorbing device, which has advantages of effectively increasing the operation safety of a racket, enhancing the hold stability and reducing the sport damage.

The problem to be solved by the present invention is that: a conventional racket is provided with longitudinal and transversal (defined as a Y-axis and an X-axis) strings on a racket frame of the racket, the racket frame is provided with longitudinal and transversal string holes which are symmetrically arranged on a periphery thereof, a single grommet is disposed inside the string hole, the string is disposed inside the single grommet so as to be woven for forming a racket surface having a certain tension (as known as pounds), shock waves of a counter shock force are generated in an instant striking moment of the string of the racket frame being in contact with the ball, and the counter shock force and the tension (tightness) of the string is in a direct ratio, in other words the higher the tension, the greater the counter shock force, the counter shock force would be transferred to the wrist or the arm through the racket, so that sport damages, for example tennis elbow due to backhand striking or golf elbow due to positive striking, may happen because there is no shock-absorbing device provided between the strings woven on the racket frame of the conventional racket, the shock waves of the counter shock force generated in the instant striking moment of the racket surface being in contact with the ball could not be absorbed and damped thereby being fully transferred to the wrist and the arm, and the racket is unable to be stably held by the sportsman, moreover, the weight of the periphery of the conventional racket frame cannot be adjusted with respect to requirements of the user; accordingly, the practicability is very much limited.

For achieving the aforesaid objectives, one technical solution provided by the present invention is to provide a racket shock-absorbing device, characterized in comprising:

a lower hard seat member, disposed at a periphery of a racket frame of a racket and arranged between two single grommets respectively formed with a string hole allowing a string to be disposed, and a top end thereof is disposed with one protrusion or more than two protrusions correspondingly along a direction defined at the periphery of the racket frame, and the lower hard seat member is formed with a recess arranged at a center and adjacent to the one or more than two protrusions;

at least one upper soft pad member, disposed on a top end of the lower hard seat member, wherein one or more than two buckle slots is disposed inside the upper soft pad member and arranged correspondingly to the one or more than two protrusions of the lower hard seat member, the string is crossly disposed and downwardly pressed at a top end defined at a center of the upper soft pad member and arranged correspondingly to the recess of the lower hard seat member;

with the lower hard seat member and the upper soft pad member of the shock-absorbing device disposed between the two single grommets of the racket frame, interferences at different timings are able to be provided and shock waves of a counter shock force generated while the string being used for striking a ball for achieving a shock-absorbing and shock absorbing effect is able to be provided.

Wherein, according to the present invention, the lower hard seat member is integrally formed at the periphery of the racket frame of the racket and arranged between the two single grommets of the string hole.

Wherein, according to the present invention, the single grommet is disposed at two ends of the lower hard seat member and downwardly extended and provided with a through hole, formed in a penetrated status, allowing the string to pass.

Wherein, according to the present invention, one or more than two protrusions are disposed inside the single grommet.

Wherein, according to the present invention, the one or more than two protrusions of the lower hard seat member are disposed inside the through hole of the single grommet, and the buckle slot correspondingly formed on the upper soft pad member is formed as a filled and flattened solid surface.

Wherein, according to the present invention, the protrusions of the lower hard seat member and the buckle slots of the upper soft pad member are symmetrically arranged or asymmetrically arranged.

Wherein, according to the present invention, the protrusions of the lower hard seat member and the buckle slots of the upper soft pad member are symmetrically formed in a cut status having two ends being aligned or in a retracted status and arranged at two ends of the protrusion and two ends of the upper soft pad member.

Wherein, according to the present invention, the protrusions of the lower hard seat member and the buckle slots of the upper soft pad member are asymmetrically formed in a cut status having one end being aligned or in a retracted status and arranged at one end of the protrusion and one end of the upper soft pad member, which are adjacently defined.

Wherein, according to the present invention, the protrusion of the lower hard seat member and the buckle slot of the upper soft pad member are able to be formed in any geometrical shape, and the geometrical shape is rectangular, arc-shaped, tooth-shaped or trapezoid.

Wherein, according to the present invention, the top end of the upper soft pad member is able to be further disposed with at least one another of the upper soft pad member having other units and the buckle slot is formed as a filled and flattened solid surface.

Advantages achieved by the present invention are as follows: the shock-absorbing device provided by the present invention comprises the lower hard seat member and the upper soft pad member, the lower hard seat member are provided with the protrusions and the recess, the upper soft pad member is disposed on the top end of the lower hard seat member or on the top end of the another upper soft pad member having other units, and the upper soft pad member is provided with the buckle slot arranged correspondingly to the protrusion of the lower hard seat member; with the lower hard seat member and the upper soft pad member of the shock-absorbing device disposed between the two single grommets of the racket frame, interferences at different timings are able to be provided and shock waves of a counter shock force generated while the string being used for striking a ball for achieving a shock-absorbing and shock absorbing effect is able to be provided; the operation safety of the racket can be effectively increased, the hold stability can be enhanced and the sport damage can be reduced; accordingly, the present invention is novel and more practical in use, and can satisfy requirements of the consumers.

DETAILED DESCRIPTION OF THE PREFERRED EMBODIMENT

One preferred embodiment of the present invention will be described with reference to the drawings for illustrating the structural assembly, the technical means and the functions to be achieved by the present invention; and the actual ratios and the arrangement of components shall not be limited by the ratios and the arrangement of components in the provided figures.

Please refer from FIG. 1 to FIG. 14; according to one preferred embodiment of the present invention, a racket shock-absorbing device 1 comprising a lower hard seat member 11 and at least one upper soft pad member 12.

Figure 1:
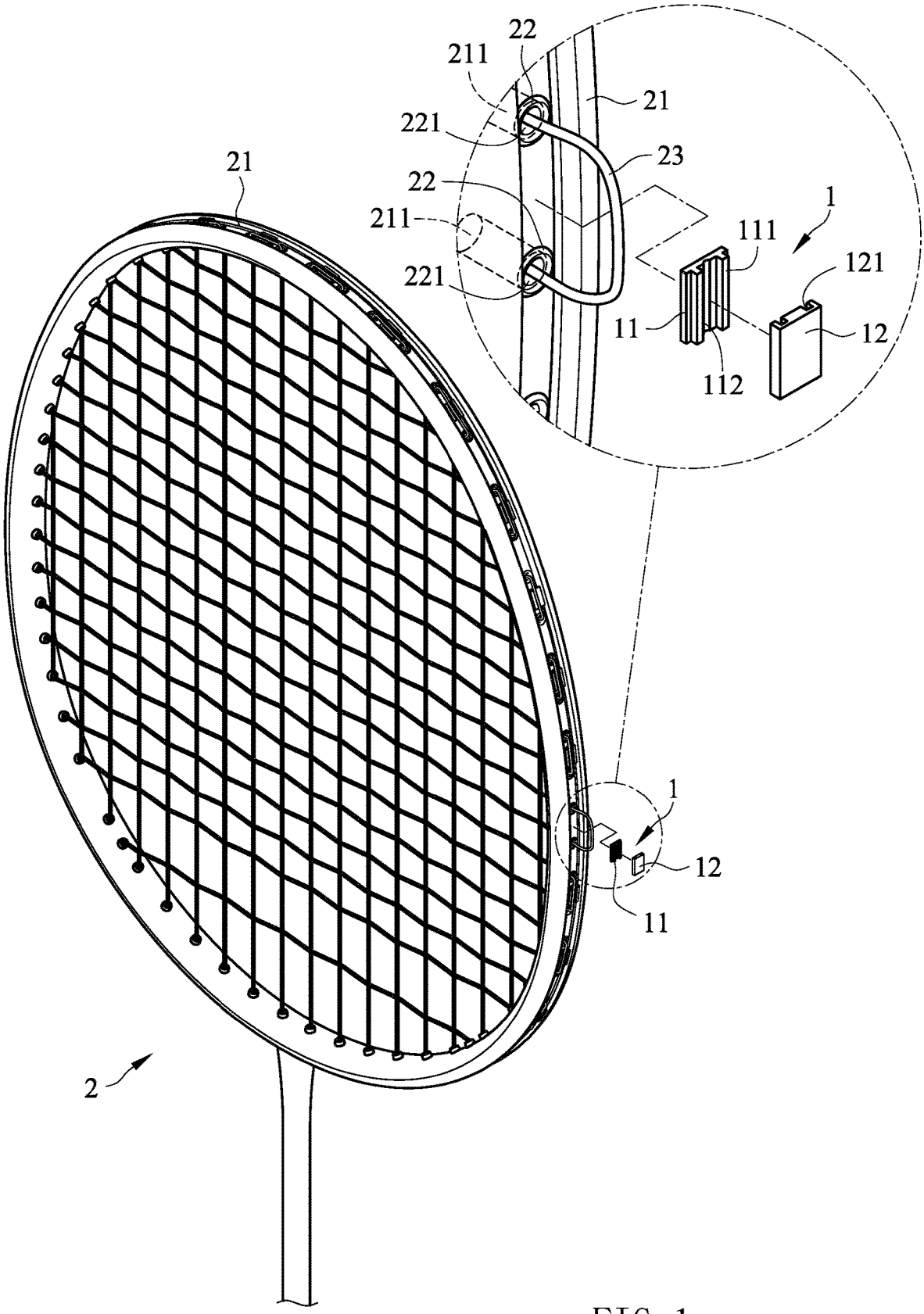
FIG. 1 is a perspective exploded view according to the present invention.
Figure 2:
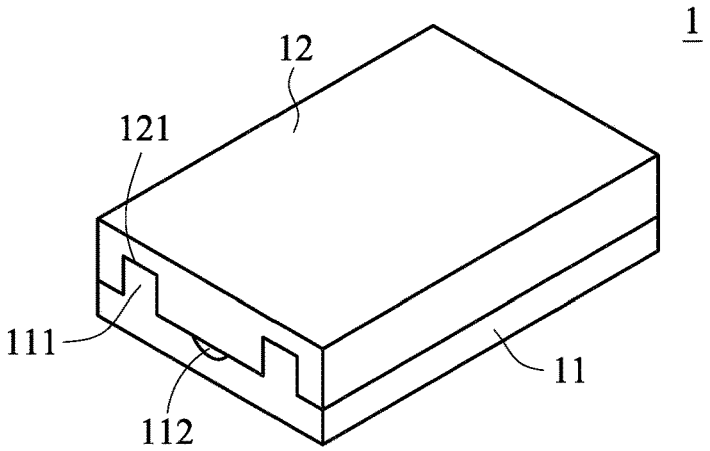
FIG. 2 is a perspective view showing the assembly according to the present invention.
Figure 3:
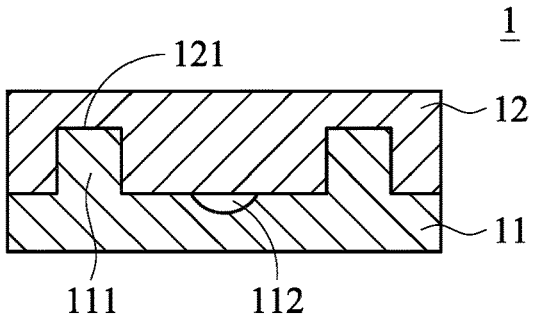
FIG. 3 is a cross sectional view showing the assembly according to the present invention.
Figure 5:
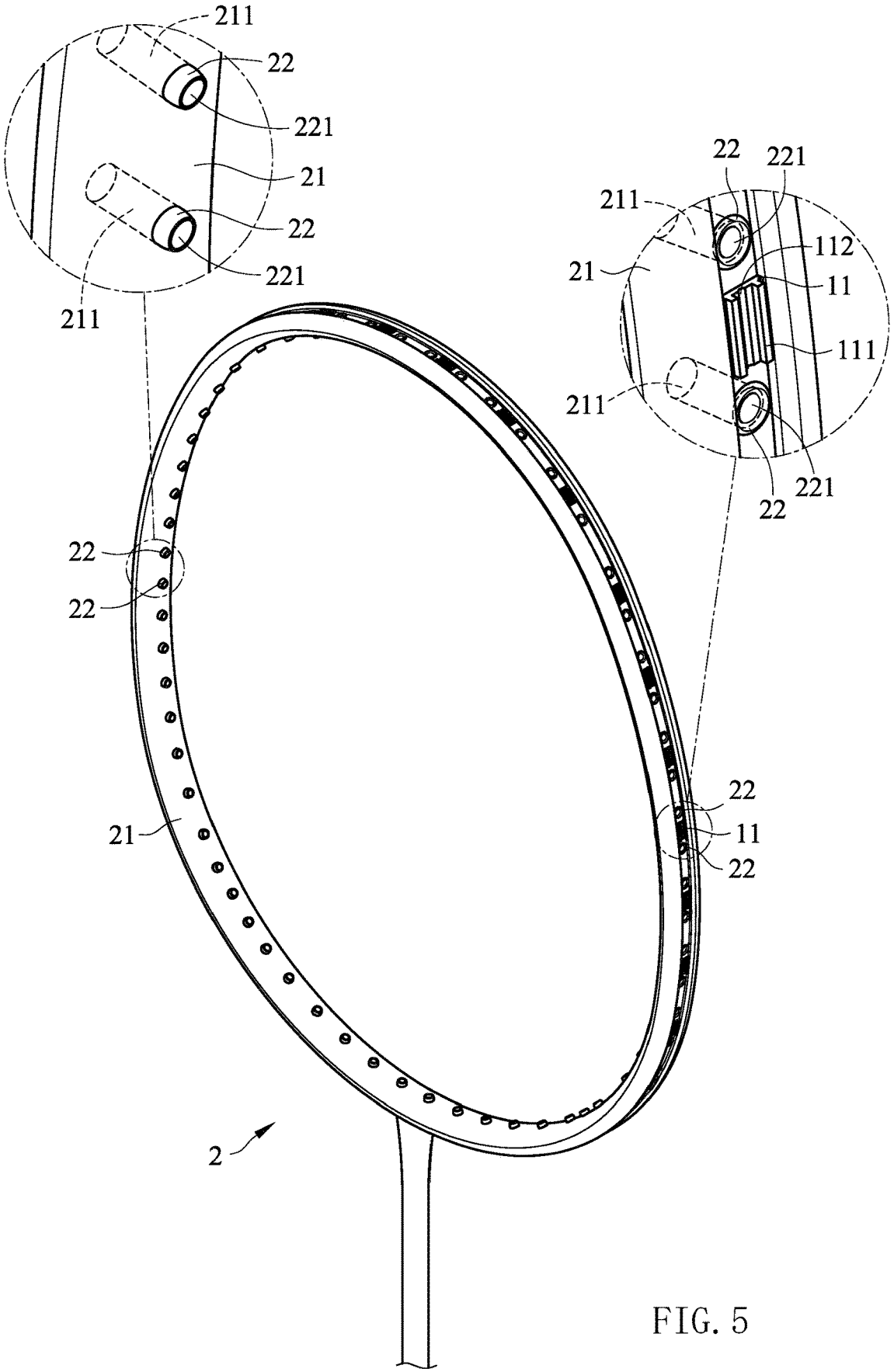
FIG. 5 is a schematic view showing the lower hard seat member being integrally formed with the racket frame according to one embodiment of the present invention.
Figure 6:
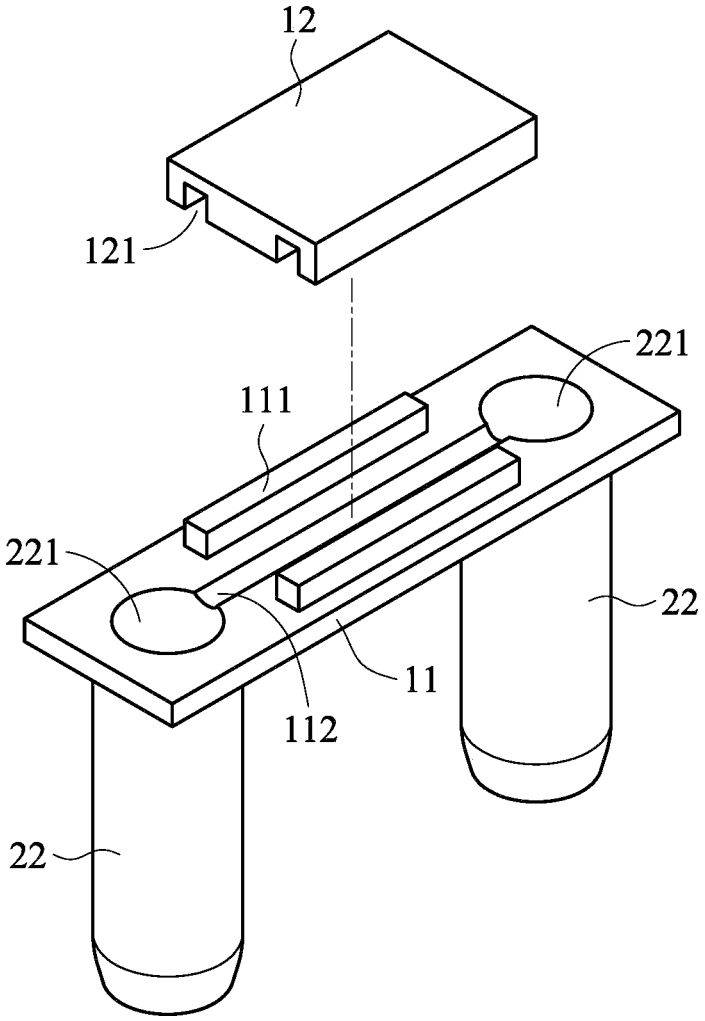
FIG. 6 is a perspective exploded view showing the single grommets being downwardly extended from two ends of the lower hard seat member and the upper soft pad member according to the present invention.
Figure 7:
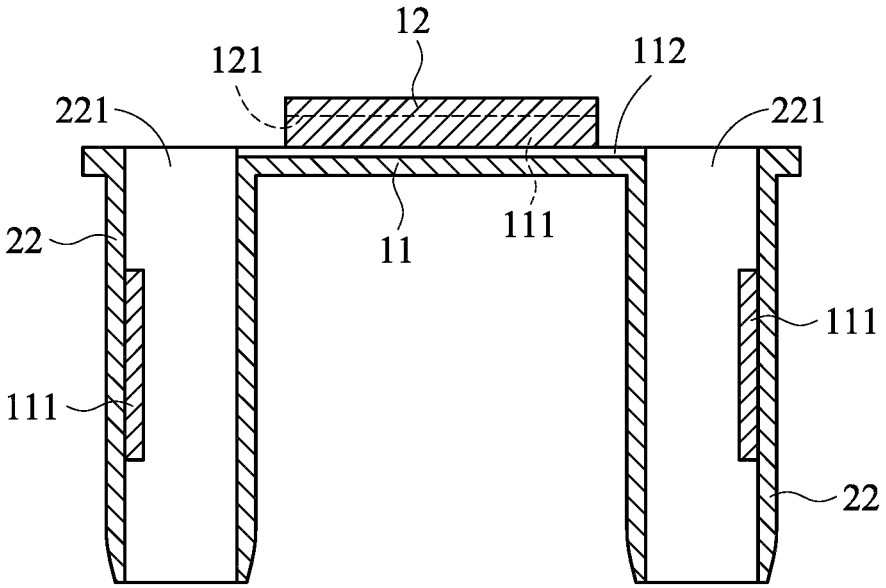
FIG. 7 is a cross sectional view showing the assembly of the through hole of the single grommet of FIG. 6 being further disposed with the protrusion and the upper soft pad member according to the present invention.
Figure 8:
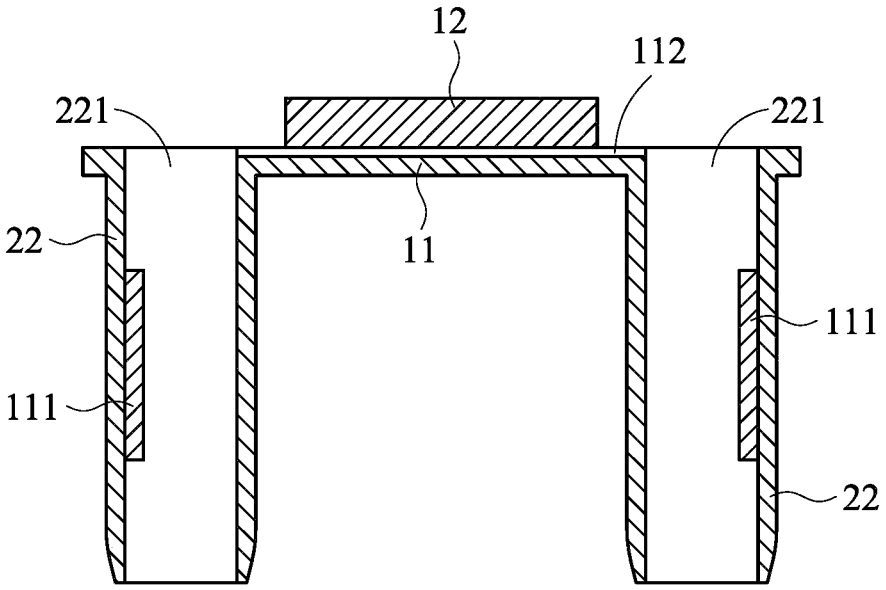
FIG. 8 is a cross sectional view showing the assembly of the lower hard seat member of FIG. 7 not being provided with the protrusion and formed in a planar status and the upper soft pad member having the buckle slot being filled and flattened for forming a solid member according to the present invention.
Figure 9:
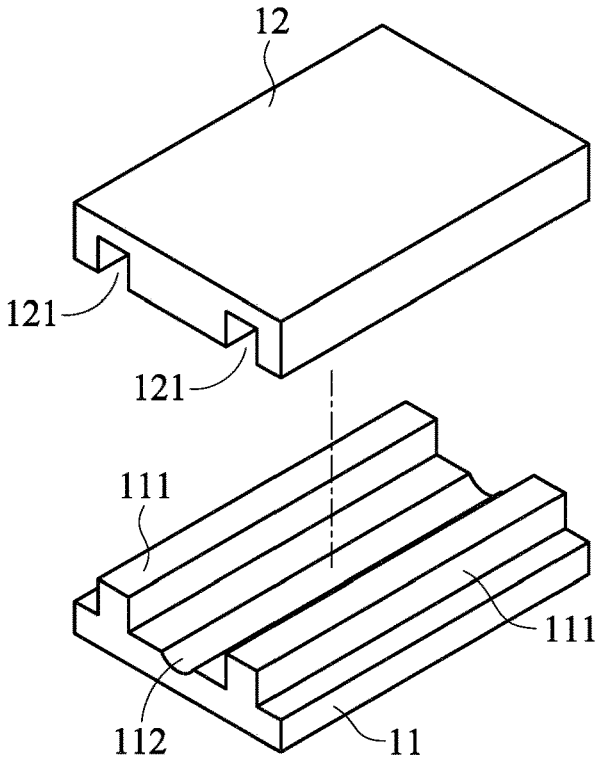
FIG. 9 is a perspective exploded view showing the protrusions of the lower hard seat member and the buckle slots of the upper soft pad member being symmetrically arranged according to the present invention.
Figure 10:
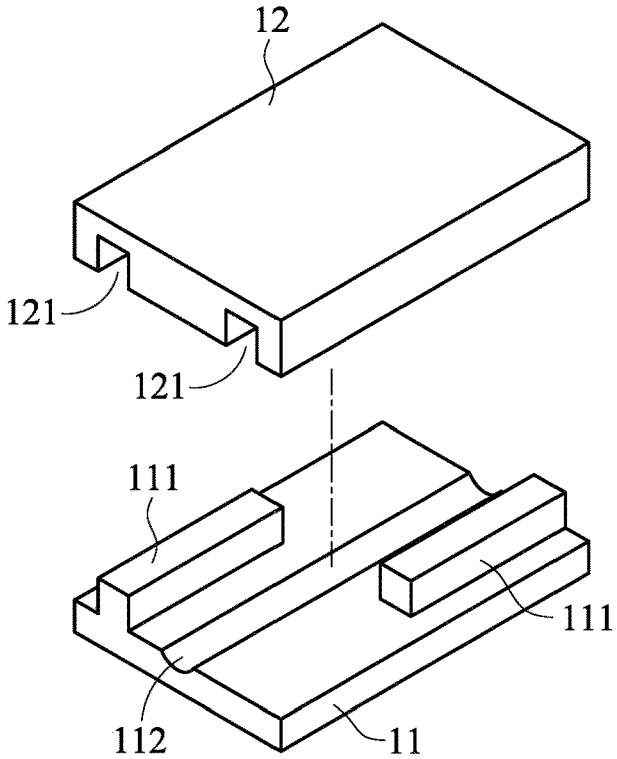
FIG. 10 is a perspective exploded view showing the protrusions of the lower hard seat member and the buckle slots of the upper soft pad member being asymmetrically arranged according to the present invention.
Figure 11:
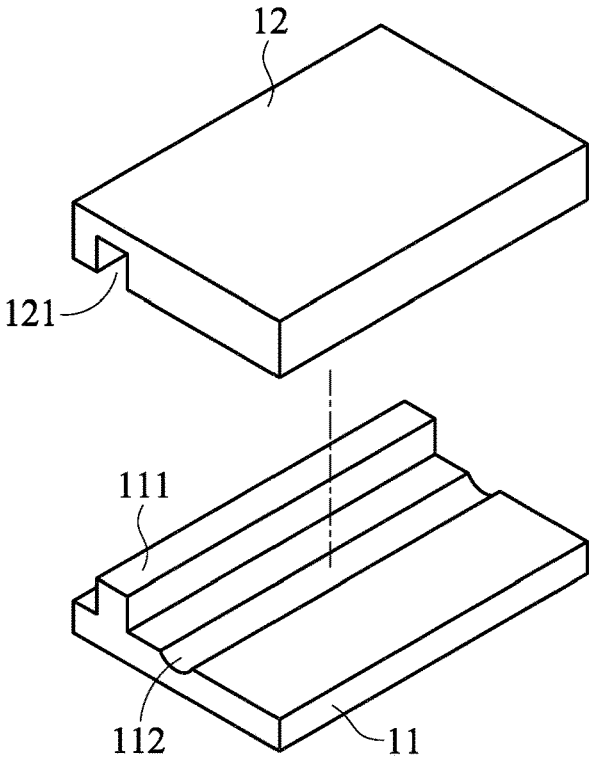
FIG. 11 is a perspective exploded view showing the single protrusion being disposed on the lower hard seat member and the single buckle slot being disposed on the upper soft pad member according to the present invention.
Figure 12:
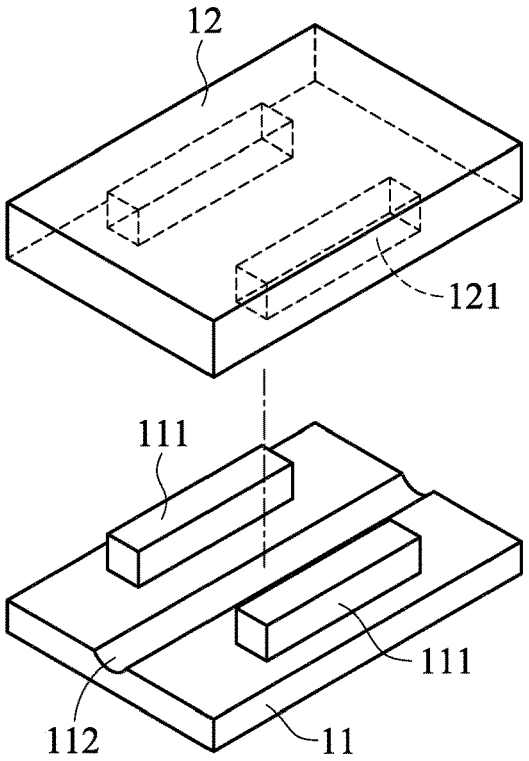
FIG. 12 is a perspective exploded view showing the protrusions of the lower hard seat member and the buckle slots of the upper soft pad member being arranged in a retracted status according to the present invention.

The lower hard seat member 11 is disposed at a periphery of a racket frame 21 of a racket 2 and arranged between two single grommets 22 respectively formed with a string hole 211 allowing a string 23 to be disposed, and a top end thereof is disposed with one protrusion 111 (as show in FIG. 11) or more than two protrusions 111 (as shown in FIG. 1, FIG. 2 and FIG. 3) correspondingly along a direction defined at the periphery of the racket frame 21, the lower hard seat member 11 is formed with a recess 112 arranged at the center and adjacent to the one or more than two protrusions 111 (as shown in FIG. 1, FIG. 2 and FIG. 3); the lower hard seat member 11 can be integrally formed at the periphery of the racket frame 21 of the racket 2 and arranged between the two single grommets 22 of the string hole 211 (as shown in FIG. 5), the single grommets 22 can be disposed at two ends of the lower hard seat member 11 and downwardly extended and provided with a through hole 221 (as shown in FIG. 6), formed in a penetrated status, allowing the string 23 to pass, and the one or more than two protrusions 111 are disposed inside the single grommet 22 (as shown in FIG. 7); the one or more than two protrusions 111 of the lower hard seat member 11 can be disposed inside the through hole 221 of the single grommet 22, and a buckle slot 121 correspondingly formed on the upper soft pad member 12 is formed as a filled and flattened solid surface (as shown in FIG. 8), the protrusions 111 of the lower hard seat member 11 and the buckle slots 121 of the upper soft pad member 12 are symmetrically arranged (as shown in FIG. 9) or asymmetrically arranged (as shown in FIG. 10); the protrusions 111 of the lower hard seat member 11 and the buckle slots 121 of the upper soft pad member 12 are symmetrically formed in a cut status having two ends being aligned (as shown in FIG. 9 and FIG. 11) or in a retracted status (as shown in FIG. 12) and arranged at two ends of the protrusion 111 and two ends of the upper soft pad member 12; the protrusions 111 of the lower hard seat member 11 and the buckle slots 121 of the upper soft pad member 12 are asymmetrically formed in a cut status having one end being aligned (as shown in FIG. 10) or in a retracted status (not shown in figures) and arranged at one end of the protrusion 111 and one end of the upper soft pad member 12, which are adjacently defined.

Figure 4:
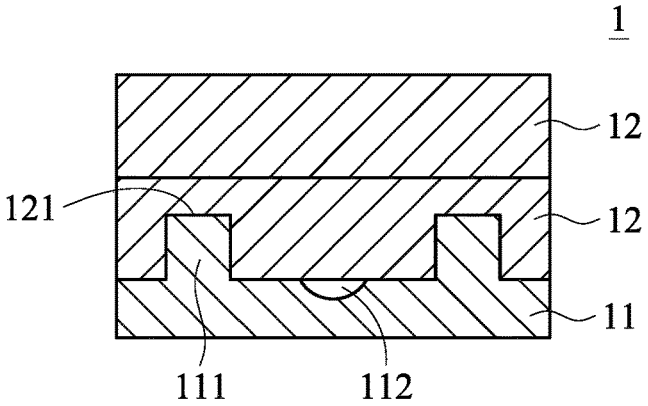
FIG. 4 is a cross sectional view showing the assembly of the upper soft pad member disposed on the lower hard seat member of FIG. 3 being further disposed with another upper soft pad member having a buckle slot which being filled and flattened in a solid status according to the present invention.
Figure 13:
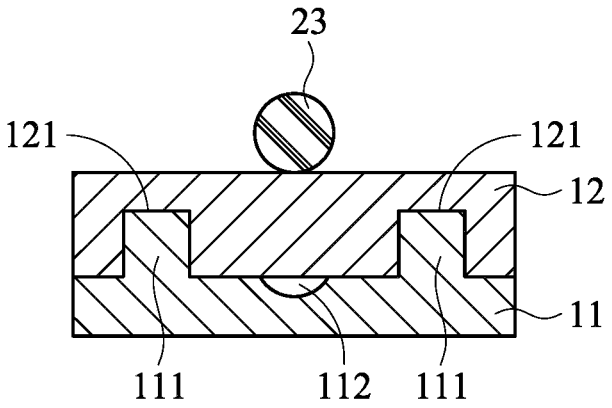
FIG. 13 is a cross sectional view showing the assembly of the shock-absorbing device wherein the string not being downwardly pressed.
Figure 14:
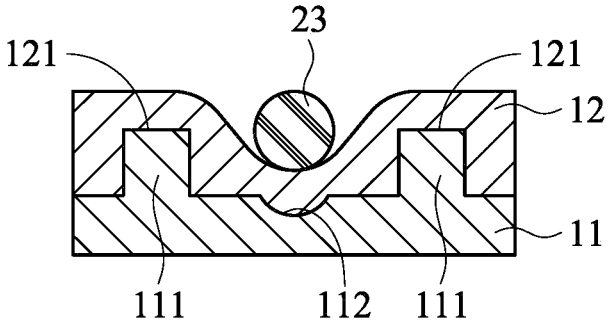
FIG. 14 is a cross sectional view showing the assembly of the shock-absorbing device wherein the string being downwardly pressed.

The at least one upper soft pad member 12 is disposed on the top end of the lower hard seat member 11, the one or more than two buckle slots 121 is disposed inside the upper soft pad member 12 and arranged correspondingly to the one or more than two protrusions 111 of the lower hard seat member 11 (as shown in FIG. 1, FIG. 2, and FIG. 3), the string 23 is crossly disposed and downwardly pressed at the top end defined at the center of the upper soft pad member 12 and arranged correspondingly to the recess 112 of the lower hard seat member 11 (as shown in FIG. 13 and FIG. 14); the top end of the upper soft pad member 12 can be further disposed with at least one another of the upper soft pad member 12 having other units and the buckle slot 121 is formed as a filled and flattened solid surface (as shown in FIG. 4); the shock-absorbing device 1 can be further utilized as a counterweight for the racket 2, so that an external force can be evenly distributed when the racket 2 is held by a user and more stabilities can be provided, the protrusion 111 of the lower hard seat member 11 and the buckle slot 121 of the upper soft pad member 12 can be formed in any geometrical shape (as shown from FIG. 1 to FIG. 14), but what shall be addressed is that the scope of the present invention is not limited to the above-mentioned arrangement, according to this embodiment, the geometrical shape can be rectangular, arc-shaped, tooth-shaped or trapezoid, but what shall be addressed is that the scope of the present invention is not limited to the above-mentioned arrangement; according to this embodiment, with the shock-absorbing device 1 comprises the lower hard seat member 11 and the upper soft pad member 12 disposed between the two single grommets 22 of the racket frame 21, advantages of providing interferences at different timings and capable of bearing shock waves of a counter shock force generated while the string 23 being used for striking a ball for achieving a shock-absorbing and shock absorbing effect can be provided.

Accordingly, the shock-absorbing device 1 provided by the present invention comprises the lower hard seat member 11 and the upper soft pad member 12, the lower hard seat member 11 are provided with the protrusions 111 and the recess 112, the upper soft pad member 12 is disposed on the top end of the lower hard seat member 11 or on the top end of the another upper soft pad member 12 having other units, and the upper soft pad member 12 is provided with the buckle slot 121 arranged correspondingly to the protrusion 111 of the lower hard seat member 11; with the lower hard seat member 11 and the upper soft pad member 12 of the shock-absorbing device 1 disposed between the two single grommets 22 of the racket frame 21, the advantages of providing interferences at different timings and capable of bearing shock waves of the counter shock force generated while the string 23 being used for striking a ball for achieving a shock-absorbing and damping effect can be provided; the operation safety of the racket 2 can be effectively increased, the hold stability can be enhanced and the sport damage can be reduced; accordingly, the present invention is novel and more practical in use, and can satisfy requirements of the consumers.

What is claimed is:

1. A racket shock-absorbing device, characterized in comprising:

a lower hard seat member, disposed at a periphery of a racket frame of a racket and arranged between two single grommets respectively formed with a string hole allowing a string to be disposed, and a top end thereof is disposed with one protrusion or more than two protrusions correspondingly along a direction defined at the periphery of the racket frame, and the lower hard seat member is formed with a recess arranged at a center and adjacent to the one or more than two protrusions;

at least one upper soft pad member, disposed on a top end of the lower hard seat member, wherein one or more than two buckle slots is disposed inside the upper soft pad member and arranged correspondingly to the one or more than two protrusions of the lower hard seat member, the string is crossly disposed and downwardly pressed at a top end defined at a center of the upper soft pad member and arranged correspondingly to the recess of the lower hard seat member;

with the lower hard seat member and the upper soft pad member of the shock-absorbing device disposed between the two single grommets of the racket frame, interferences at different timings are able to be provided and shock waves of a counter shock force generated while the string being used for striking a ball for achieving a shock-absorbing and shock absorbing effect is able to be provided.

2. The racket shock-absorbing device as claimed in claim 1, wherein the lower hard seat member is integrally formed at the periphery of the racket frame of the racket and arranged between the two single grommets of the string hole.

3. The racket shock-absorbing device as claimed in claim 1, wherein the single grommet is disposed at two ends of the lower hard seat member and downwardly extended and provided with a through hole, formed in a penetrated status, allowing the string to pass.

4. The racket shock-absorbing device as claimed in claim 3, wherein one or more than two protrusions are disposed inside the single grommet.

5. The racket shock-absorbing device as claimed in claim 3, wherein the one or more than two protrusions of the lower hard seat member are disposed inside the through hole of the single grommet, and the buckle slot correspondingly formed on the upper soft pad member is formed as a filled and flattened solid surface.

6. The racket shock-absorbing device as claimed in claim 1, wherein the protrusions of the lower hard seat member and the buckle slots of the upper soft pad member are symmetrically arranged or asymmetrically arranged.

7. The racket shock-absorbing device as claimed in claim 6, wherein the protrusions of the lower hard seat member and the buckle slots of the upper soft pad member are symmetrically formed in a cut status having two ends being aligned or in a retracted status and arranged at two ends of the protrusion and two ends of the upper soft pad member.

8. The racket shock-absorbing device as claimed in claim 6, wherein the protrusions of the lower hard seat member and the buckle slots of the upper soft pad member are asymmetrically formed in a cut status having one end being aligned or in a retracted status and arranged at one end of the protrusion and one end of the upper soft pad member, which are adjacently defined.

9. The racket shock-absorbing device as claimed in claim 1, wherein the protrusion of the lower hard seat member and the buckle slot of the upper soft pad member are able to be formed in any geometrical shape, and the geometrical shape is rectangular, arc-shaped, tooth-shaped or trapezoid.

10. The racket shock-absorbing device as claimed in claim 1, wherein the top end of the upper soft pad member is able to be further disposed with at least one another of the upper soft pad member having other units and the buckle slot is formed as a filled and flattened solid surface.

* * * * *